United States Patent [19]

Woolgar

[11] 4,385,232

[45] May 24, 1983

[54] IMAGE INTENSIFIER DEVICES

[75] Inventor: Anthony J. Woolgar, Chelmsford, England

[73] Assignee: English Electric Valve Company Limited, Chelmsford, England

[21] Appl. No.: 43,468

[22] Filed: May 30, 1979

[30] Foreign Application Priority Data

May 30, 1978 [GB] United Kingdom ..... 23753/78

[51] Int. Cl.[3] ..... H01J 31/50; H01J 40/14

[52] U.S. Cl. ..... 250/213 VT

[58] Field of Search ..... 250/213 VT; 313/103 R, 313/104, 105 R, 106; 358/220, 223

[56] References Cited

U.S. PATENT DOCUMENTS 2,836,360 5/1958 Adams ..... 313/105

3,665,247 5/1972 Gordon ..... 250/213 VT 3,976,874 8/1976 Lange et al. ..... 250/213 VT

*Primary Examiner*—Theodore M. Blum

*Attorney, Agent, or Firm*—Diller, Ramik & Wight

[57] ABSTRACT

The invention provides an image intensifier arrangement in which for each stage either the luminescent screen or the photo cathode thereof is decoupled by resistive decoupling with respect to the capacitances of a power supply source which is provided to supply high tension thereto. In each case the resistive decoupling consists of a resistor of such value as to provide a time constant with the capacitance of the relevant output point of the power supply which is many times greater than the duration of a typical high energy flash to which the intensifier is likely to be exposed in operation.

5 Claims, 5 Drawing Figures

IMAGE INTENSIFIER DEVICES

This invention relates to image intensifier devices.

Typically an image intensifier consists of one or more stages each consisting essentially of a photo emissive cathode at an input end and a luminescent screen at the output end. Typically the luminescent screen consists of a phosphor layer having a backing layer of aluminium.

BRIEF DESCRIPTION OF THE DRAWING

Referring to FIG. 1, the device consists of a transparent input window 1, which, whilst the individual light fibres are not represented, is of the fibre optic type as known per se. The input window 1 is sealed by means of a glass frit seal 2 to a cathode input window mounting flange 3. The mounting flange 3 is carried from a cathode body housing 4. Electrically connected to the cathode body housing 4, and hence to the mounting flange 3, is a getter shield 5.

Figure 1:
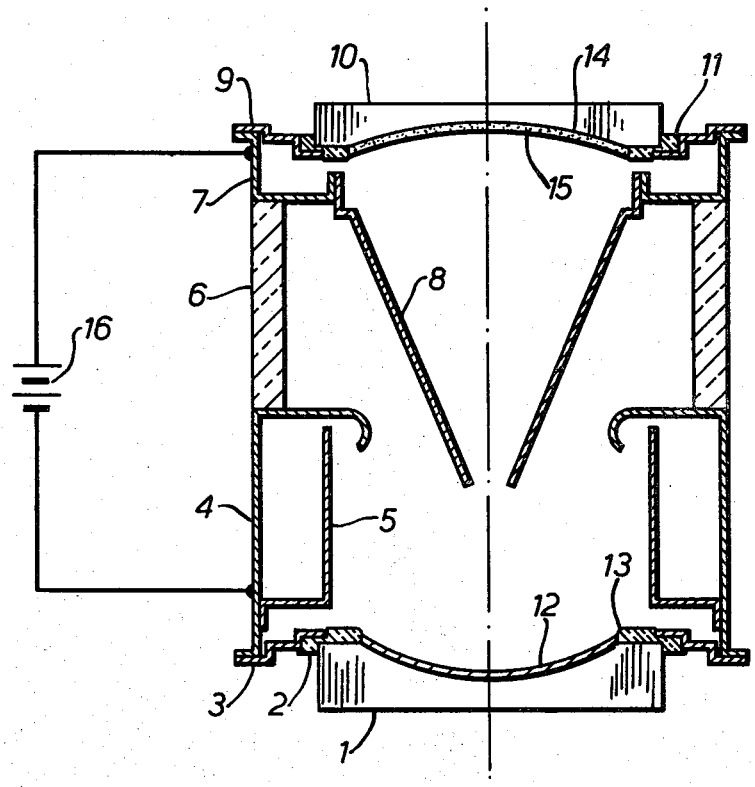
FIG. 1 of the accompanying drawings is a section through a typical image intensifier device as at present known. The device illustrated in FIG. 1 is a single stage device, but could form one module of a multi-stage image intensifier device.

A glass or ceramic body insulator 6 separates the cathode body housing 4 from an anode body housing 7. The anode body housing 7 supports an anode focusing cone electrode 8, as known per se. Mounted in an anode output window or screen mounting flange 9 is a transparent output window 10, which is of the fibre optic type, although again the individual optic fibres are not represented. The window 10 is sealed to the mounting flange 9 by another glass frit seal 11.

At one end of the tube and carried by the transparent input window 1 is a photo-emissive cathode layer 12 provided with a peripheral photo-cathode metal contact layer 13, the latter making electrical contact with the mounting flange 3.

At the output end of the device and carried by the transparent output window 10 is a luminescent (phosphor) screen 14, which has an aluminium backing layer 15 electrically united with the mounting flange 9.

Operating potential difference is created between the housings 4 and 7 by means of a d.c. source represented at 16.

Figure 2:
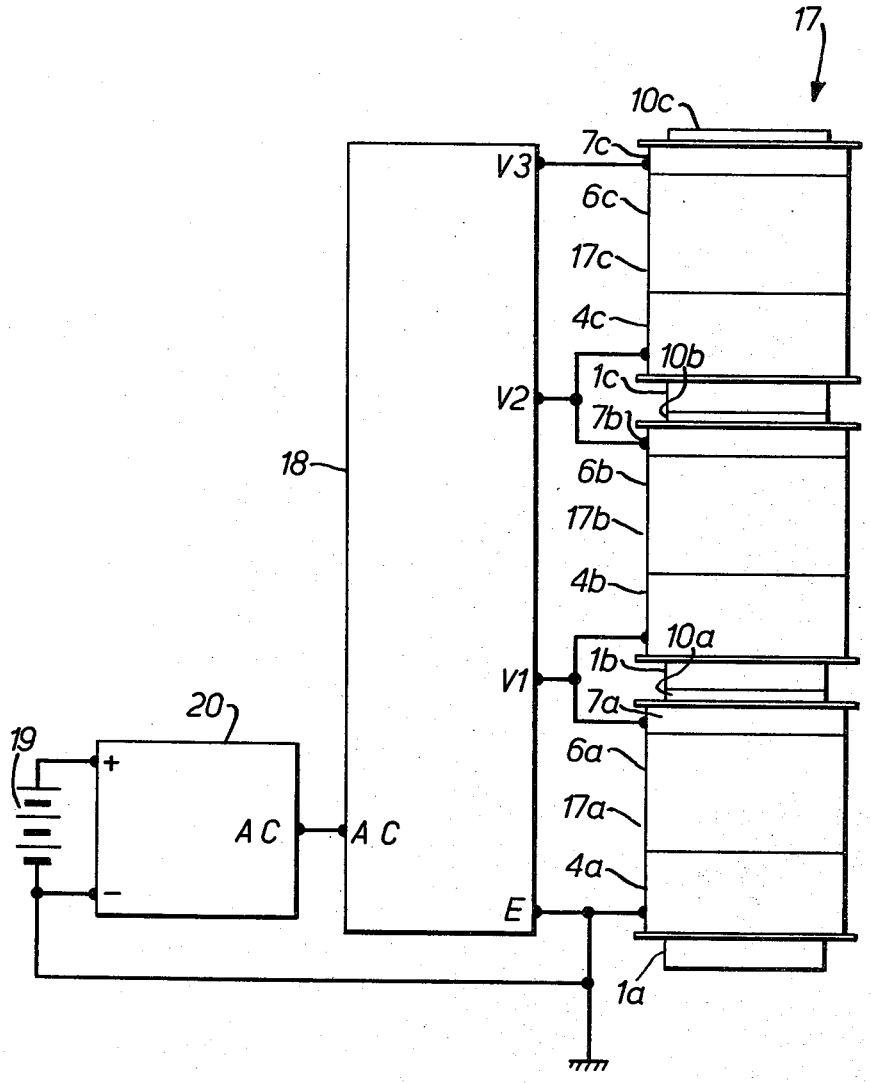
FIG. 2 of the accompaying drawings illustrates a known three stage image intensifier each of the stages of which are individually as illustrated in FIG. 1, connected in a circuit arrangement.

Referring to FIG. 2, the image intensifier tube 17 consists of three stages 17*a*, 17*b* and 17*c*, each of which is individually as illustrated in FIG. 1 and corresponding references are used for corresponding parts, but with the appropriate suffixes a, b or c. Thus, the input cathode window of the three stage intensifier is 1*a* and the final output display window is 10*c*.

A power supply in the form of an extra high tension multiplier rectifier assembly 18 is provided to supply high tension across the stages 17*a*, 17*b* and 17*c* of the device 17 from four supply points referenced "E", "V1", "V2" and "V3". The point E is at system earth potential. The potential difference between point V1 and point E is 12 kV, the potential difference between point V2 and point E is 27 kV and the potential difference between point V3 and point E is 42 kV. The rectifier assembly 18 is itself supplied from a d.c. supply 19 via an inverter 20.

Point E is connected to cathode body housing 4*a* of intensifier module 17*a*, whilst the anode body housing 7*a* of that module together with the cathode body housing 4*b* of module 17*b* is connected to point V1. The anode body housing 7*b* of module 17*b* together with the cathode body housing 4*c* of module 17*c* is connected to point V2. The anode body housing 7*c* of module 17*c* is connected to point V3.

When such an image intensifier is exposed to very bright flashes of light a high energy density pulse of electrons is generated at the photo cathode, which can cause irreparable damage to the phosphor screen leaving this permanently scarred. Where the phosphor screen consists of a layer of phosphor with a backing layer of aluminium, quite commonly the energy density in the pulse of electrons causes the aluminium backing layer locally to melt.

One object of the present invention is to provide an improved image intensifier arrangement, single or multi staged, in which the above difficulty is reduced.

According to this invention an image intensifier arrangement is provided including an image intensifier having at least one stage of which the luminescent screen or photo-cathode thereof is decoupled with respect to the capacitances of the power supply source provided to supply high tension thereto. Whether it is the luminescent screen or the photo-cathode which is decoupled will depend upon the polarity of the high tension supply. Where this is positive, the luminescent screen will be decoupled, in which case normally no decoupling would be provided in respect of the photo-cathode.

Preferably said decoupling is resistive decoupling.

Where said image intensifier comprises more than one stage, preferably the luminescent screens or photo-cathodes of all of the stages are decoupled with respect to the capacitances of the power supply provided to supply high tension thereto.

Preferably in each case said resistive decoupling comprises a resistor connected between said luminescent screen photo-cathode and the output point of a power supply provided to supply high tension thereto, the value of said resistor being such as to provide a time constant with the capacitance at that output point of said power supply which is many times greater than the duration of a typical high energy flash likely to occur in operation. The value of said resistor should not be so large as to cause serious loss of output potential with the order of photo currents used during normal operation.

Typically, the value of said resistor will lie in the range 100 MΩ to 1 GΩ.

Typically, where said image intensifier is a multi staged image intensifier, the value of a decoupling resistor utilised towards the input end of said intensifier will be larger than the value of a decoupling resistor utilised nearer the output end thereof. Normally the anode screen or each of the anode screens will be in accordance with the invention in our co-pending UK application No. 23754/78, that is to say, broadly, the or each luminescent screen will comprise a layer of luminescent material having in contact therewith a layer of material whose thermal properties are such that said last mentioned layer tends to act as a heat sink to absorb energy from high energy density pulses of electrons impinging thereon.

Preferably where said image intensifier is a multi staged image intensifier, the anode screen of one stage is connected to the anode screen of a previous stage via a coupling capacitor.

Preferably where there are at least three stages to said multi stage intensifier, preferably the anode screen of each stage is connected to the anode screen of a stage preceding it via a coupling capacitor.

The value of the or each coupling capacitor should be greater than the intensifier self plus stray capacitances effectively connected in parallel with it.

Preferably in the case of a multi stage intensifier, where the anode screen of a preceding stage is provided to operate at the same potential as the photo cathode of a following stage and that first mentioned anode screen is decoupled with respect to the capacitance of the power supply by a resistor connected in a path between it and the power supply point therefore, said following photo-cathode is connected to the same power supply point via a unilaterally conducting device, which is so poled that as, in operation, the potential at said last mentioned anode screen falls, stray capacitances between said last mentioned output screen and said last mentioned photo-cathode pulls down the potential of said last mentioned photo-cathode such that said diode is switched off.

The invention is further described with reference to and illustrated in FIGS. 3 to 5 of the accompanying drawings which illustrate three examples of three stage image intensifier arrangements in accordance with the present invention.

Figure 3:
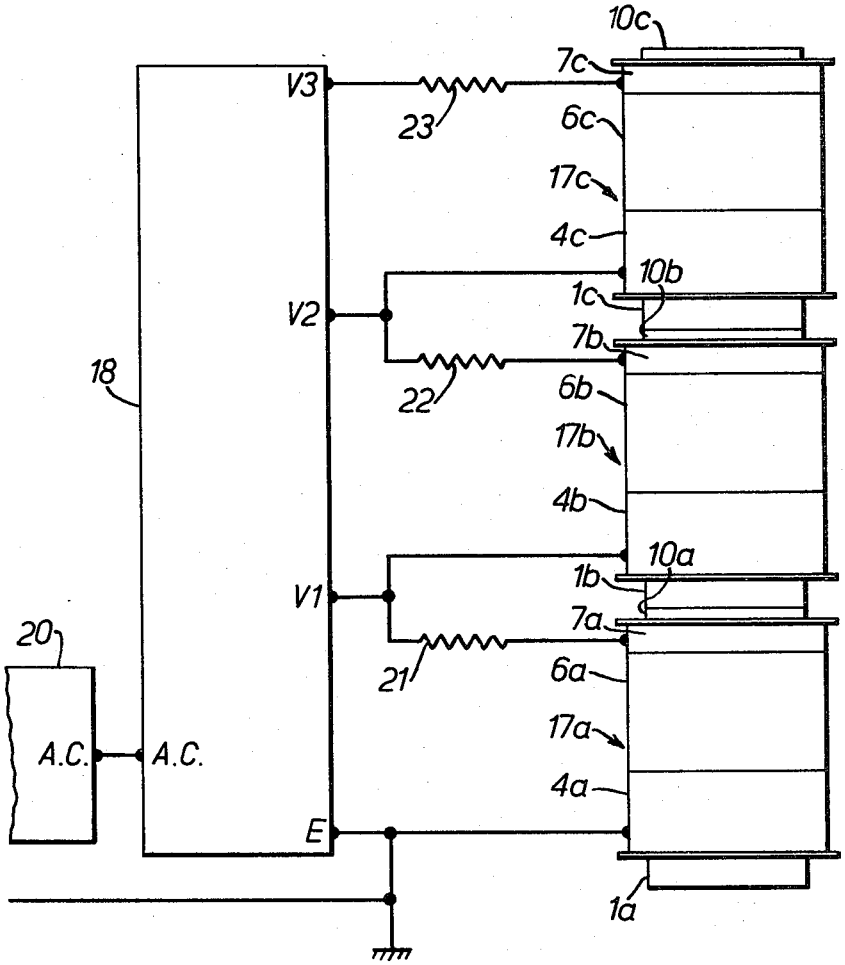
FIGS. 3–5 are image intensifiers in accordance with the present invention.
Figure 4:
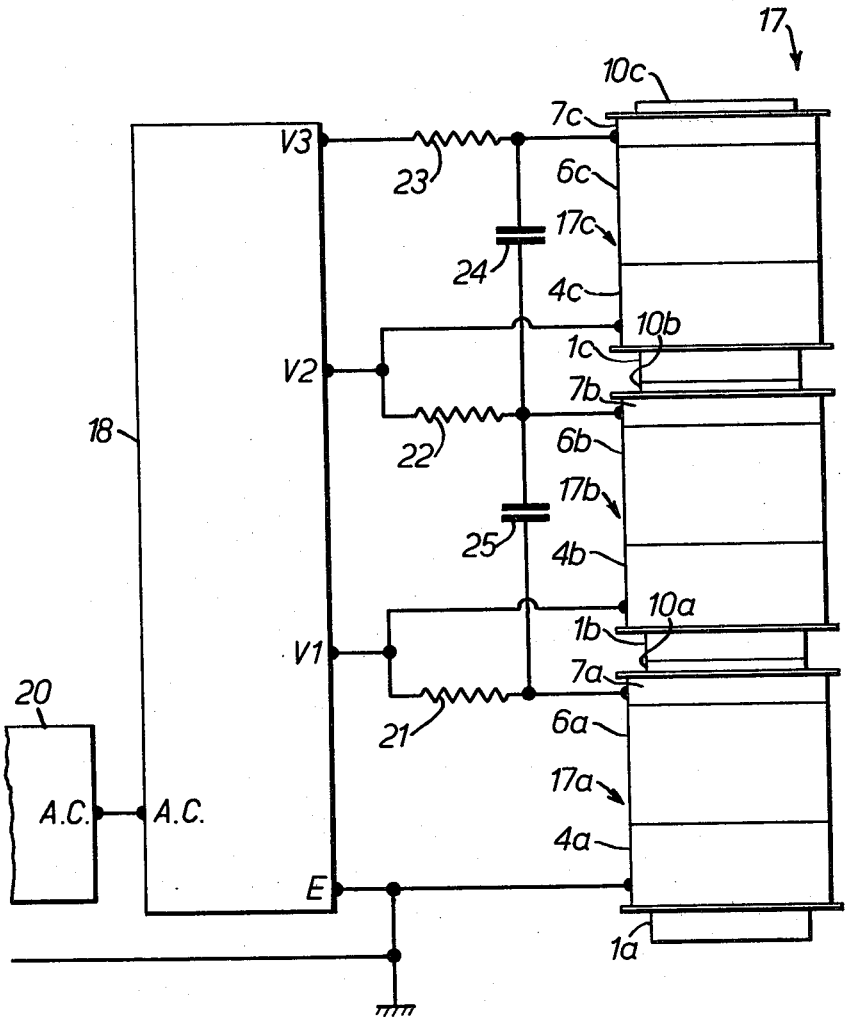
Figure 5:
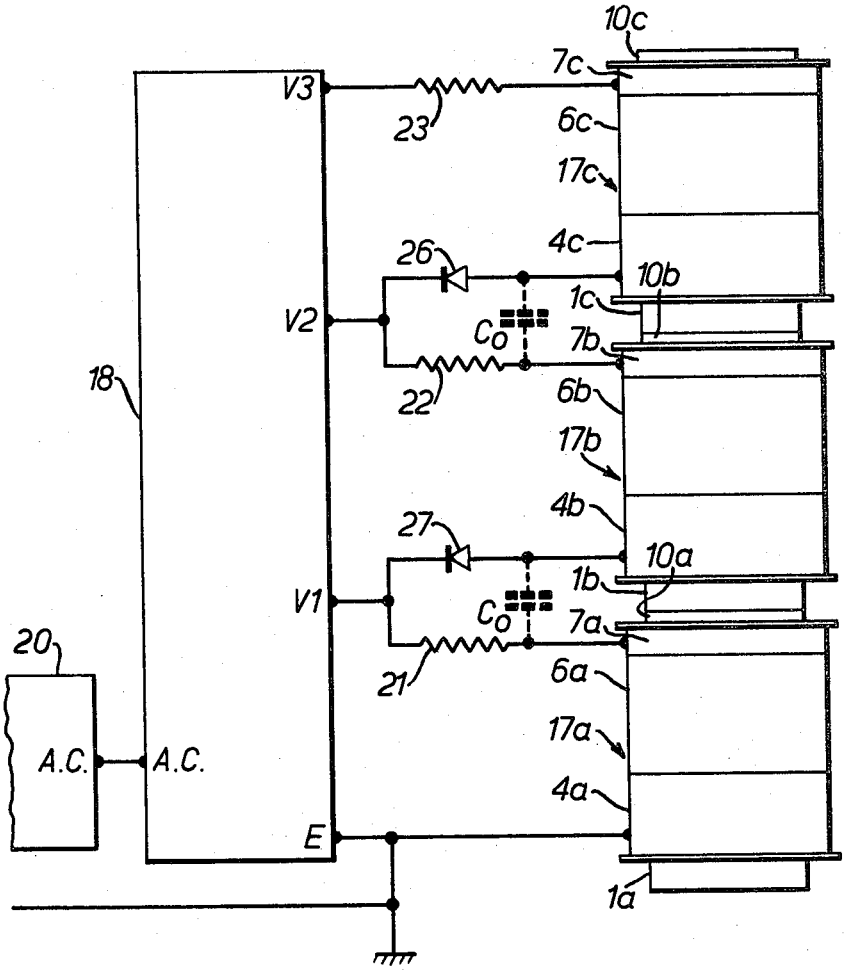

In FIGS. 3 to 5, like references are used for like parts in FIGS. 1 and 2.

Referring to FIG. 3, the arrangement illustrated is essentially similar to that of the known arrangement illustrated in FIG. 2 except for the provision of high voltage (pulse) rating resistors 21, 22 and 23 providing resistive decoupling of the image intensifier stages 17*a*, 17*b* and 17*c* respectively from the energy stored in the substantial reservoir capacitances of the power supply 18. In this case, and in the cases of FIGS. 4 and 5, the polarity of the power supply is positive.

Resistor 21 is connected between point V1 of the rectifier assembly 18 and the anode body housing 7*a* of the module 17*a*. Resistor 22 is connected between the point V2 of the rectifier assembly 18 and the anode body housing 7*b* of module 17*b*. Resistor 23 is connected between point V3 of the rectifier assembly 18 and the anode body housing 7*c* of module 17*c*.

The resistive values of the resistors 21, 22 and 23 should be large enough to provide a time constant with the capacitances of the rectifier assembly 18 (typically 100 to 200 pF) of many times (e.g. $>10^{-2}$ sec.) a typical flash pulse duration, but not large enough to cause serious loss of output potential with the order of photo currents used during normal operation. Typically the values of resistors 21, 22 and 23 would lie in the range 100 MΩ to 1 GΩ, but the values would depend upon the size of the tube and its application. In this present example, the image intensifier tube 17 is one of 25 mm format and the value of resistor 21 is typically 1000 MΩ, whilst resistors 22 and 23 are typically 500 MΩ. With the anode screens decoupled from the energy stored in the reservoir capacitance of the rectifier assembly 18, the energy dissipated by the fluorescent screens of the modules 17*a*, 17*b* and 17*c* will be the smaller energy stored in the self plus stray capacitances of the module stages themselves. With a 25 mm format, three stage image intensifier as at present being considered, the self capacitances of one module stage is of the order of 4 pF, but the stray capacitances may be several times greater than this figure.

Thus even when decoupled as described, the luminescent screens may be required to dissipate energy which, with high energy flashes, would still be sufficiently high to cause damage. For this reason, the fluorescent screen assemblies in each of the modules 17*a*, 17*b* and 17*c* are in accordance with the invention which is the subject of our co-pending application number No. 23754/78. This applies also to the embodiments to be described with reference to FIGS. 4 and 5.

Referring now to FIG. 4, the arrangement illustrated therein is identical to that illustrated in FIG. 3 except that high voltage rating capacitors 24 and 25 are connected respectively between the anody body housings 7*c* and 7*b* and between anode body housings 7*b* and 7*a*.

Capacitors 24 and 25 act as coupling capacitors and are provided to be of values greater than the intensifier self plus stray capacitances. In this present example, capacitor 24 is typically a 50 pF capacitor and capacitor 25 is typically a 100 pF capacitor. The values of resistors 21, 22 and 23 are similar to those in the case of FIG. 3.

In operation of the circuit of FIG. 4, the anodes of the intensifier module stages are decoupled as in the case of FIG. 3. A photocurrent pulse in any module stage produces a potential pulse across resistors 23, 22 or 21 and the pulse is fed to one or more of the screen of the other module stages via the coupling capacitors 24 and 25. This pulse fed to the other screens provides temporary protection by reducing their potentials with respect to their corresponding cathodes.

Referring to FIG. 5, here again the arrangement is identical to that of FIG. 3 except for the provision of high voltage isolation diodes 26 and 27.

The diodes 26 and 27 are provided to take into consideration, the effect of the part $C_o$ of the stray capacitances of the image intensifier, which exists between the screen of one stage and the cathode of an adjacent stage in a fibre optical coupled assembly such as that illustrated herein. In the operation of an image intensifier arrangement as described in the present FIGS. 3 and 4, when a protection circuit operates, potential difference appears across the coupled pairs of optics. Although these potentials are transient pulses they can cause break down phenomena within the fibre optics and individual fibres may luminesce causing a degradation of the image, which is usually temporary but is undesirable. The diodes 26 and 27 act to isolate the cathodes of the second and third module stages 17*c* and 17*b* from the supply 18 during the negative pulse on the adjacent anode screen. As the potential at the anode of module stage 17*a* and 17*b* falls the stray capacitance through the optics, pulls down the potential of the photocathode of module stage 17*b* or 17*c* and thus switches off the diode 27 or 26 respectively. This reduces both the stress on the fibre optics and, by decoupling the stray capacitances between the screen and the adjacent cathode, the stored energy dissipated in the screen and this assists the protection of the screen from flash damage. The tendency is for all of the electrode potentials to fall together and this assists the protection mechanism.

Whilst such an embodiment is not illustrated, capacitors such as 24 and 25 of FIG. 4 may be included in a circuit arrangement such as that shown in FIG. 5.

I claim:

1. An image intensifier arrangement including a multi-stage image intensifier wherein either the luminescent anode screen or the photocathode of each of the stages is decoupled with respect to the capacitance of the power supply provided to supply high tension thereto, this decoupling being effected by a resistor connected between said luminescent screen or said photocathode and the output point of the power supply, the value of said resistor being such as to provide a time constant with the capacitance at that output point of said power supply which is many times greater than the duration of a typically high energy flash likely to occur in operation, and wherein the value of the decoupling resistor utilised in a stage towards the input end of said intensifier is larger than the value of the decoupling resistor utilised in a stage nearer the output end thereof.

2. An arrangement as claimed in claim 1 and wherein the value of each said resistor lies in the range 100 MΩ to 1 GΩ.

3. An arrangement as claimed in claim 1 or 2 and wherein the anode screen of each stage is connected to the anode screen of the previous stage via a coupling capacitor.

4. An arrangement as claimed in claim 1 or 2 and wherein the anode screen of a stage is provided to operate at the same potential as the photocathode of the following stage and that anode screen is decoupled with respect to the capacitance of the power supply by a resistor connected in a path between it and the power supply point therefor, and wherein said following photocathode is connected to the same power supply point via a unilaterally conducting device which is so poled that as, in operation, the potential at said anode screen falls, the stray capacitance between said anode screen and said following photocathode pulls down the potential of said following photocathode such that said diode is switched off, thus breaking the path between said following photocathode and the power supply point therefor.

5. In an image intensifier arrangement comprising at least two image intensifier stages, each including a photocathode and a luminescent anode screen adapted to be capacitively supplied with high tension therebetween, in which the photocathode of one stage is adapted to receive predominantly low level light energy from a normal scene of view as well as transient high energy light flashes which would result in damage to the luminescent anode screens of the arrangement, the improvement which comprises means for protecting said anode screens from damage due to said transient light flashes without serious degradation of the ouput image of the arrangement from the normal scene of view, said means comprising a resistor connected, dependent upon the polarity of the capacitively supplied high tension, between either the luminescent anode screen or the photocathode of each of said stages and the corresponding output point of the capacitively supplied high tension, the value of each resistor being such as to provide a time constant with the capacitance of its corresponding output point which is many times greater than the duration of a light flash, and the value of that resistor connected to said one stage being greater than that of the resistor connected to any other stage.

* * * * *